US009959952B2

(12) United States Patent
Fuller

(10) Patent No.: US 9,959,952 B2
(45) Date of Patent: May 1, 2018

(54) SEMI-CONDUCTIVE RUBBER SHIELDED SHUTTLE CAR CABLE

(71) Applicant: NEXANS, Paris (FR)

(72) Inventor: Mark Fuller, Beaver, PA (US)

(73) Assignee: NEXANS, Paris (FR)

( * ) Notice: Subject to any disclaimer, the term of this patent is extended or adjusted under 35 U.S.C. 154(b) by 751 days.

(21) Appl. No.: 14/547,607

(22) Filed: Nov. 19, 2014

(65) Prior Publication Data

US 2016/0141074 A1 May 19, 2016

(51) Int. Cl.

| | |
|---|---|
| ***H01B 7/00*** | (2006.01) |
| ***H01B 9/00*** | (2006.01) |
| ***H01B 11/00*** | (2006.01) |
| ***H01B 3/28*** | (2006.01) |
| ***H01B 1/02*** | (2006.01) |
| ***H01B 3/00*** | (2006.01) |
| ***H01B 3/30*** | (2006.01) |
| ***H01B 7/04*** | (2006.01) |
| *H01B 7/18* | (2006.01) |

(52) U.S. Cl.

CPC ..... *H01B 3/28* (2013.01); *H01B 1/02* (2013.01); *H01B 3/004* (2013.01); *H01B 3/301* (2013.01); *H01B 7/041* (2013.01); *H01B 7/1875* (2013.01)

(58) Field of Classification Search

CPC ..... C08K 3/04; C08K 3/22; C08L 101/04; C08L 71/00; G02B 6/4401; G01B 11/02; G01B 11/028; G01D 5/35358; G03G 15/02; G03G 15/08; G03G 15/16; H01B 1/02; H01B 3/004; H01B 3/28; H01B 3/301; H01B 7/18; H01B 7/041; H01B 7/1875; H01B 9/003; H01B 9/027

USPC ..... 174/26 R; 356/634; 385/101; 439/465

See application file for complete search history.

(56) References Cited

U.S. PATENT DOCUMENTS

2006/0105616 A1* 5/2006 Fisher ..... H01B 9/027 439/465

2014/0049786 A1* 2/2014 Knuepfer ..... G01B 11/02 356/634

FOREIGN PATENT DOCUMENTS

JP 2007154123 A * 6/2007

* cited by examiner

*Primary Examiner* — Timothy Thompson
*Assistant Examiner* — Guillermo Egoavil
(74) *Attorney, Agent, or Firm* — Sofer & Haroun, LLP

(57) ABSTRACT

An electric cable is provided having a plurality of insulated power conductors, a pilot and ground wire assembly and a saddle positioned between the plurality of insulated power conductors with the pilot and ground assembly being positioned within the saddle, where the saddle is constructed from a semi-conductive polymer. An inner sheath surrounds the saddle and the plurality of insulated power conductors, where the inner sheath is constructed from a semi-conductive polymer and where the inner sheath, saddle and the plurality of conductors form a flat cable. An outer insulating sheath disposed around the outside of the inner sheath.

8 Claims, 2 Drawing Sheets

SEMI-CONDUCTIVE RUBBER SHIELDED SHUTTLE CAR CABLE

FIELD OF THE INVENTION

This application relates to a power cable. More particularly, the present application relates to a power cable for use with mining shuttle cars and the like.

DESCRIPTION OF THE RELATED ART

Mining shuttle cars are typically powered by electric motors, using an attached cable connected to a remotely located power source/generator. These cables are subject to significant mechanical stresses from both the general mining environment as well as the coiling and uncoiling that occurs hundreds of times a day as the shuttle car travels back and forth in the mine.

As such, these cables need a significant amount of insulation and polymeric armoring to survive the environment while being flexible enough to be continuously coiled and uncoiled. However, more insulation provides better protection but makes the cable heavier and stiffer.

Moreover, aside from the mechanical considerations, safety concerns in mines may require that the cables not only be fitted with pilot and/or grounding wires but also that the cables have an electrically conductive screen surrounding the insulation of the conductors. Such pilot and/or ground wires as additional components inherently add additional weight and stiffness. Additionally, typical screens for surrounding the conductor are made from braided copper which although flexible cannot endure continued flexing (coiling/uncoiling) over prolonged periods because they can become frayed. Moreover such frayed braided conductors can actually start to cut into the wire insulation again shortening the life of the cable.

OBJECT AND SUMMARY

The present arrangement overcomes the drawbacks associated with the prior art and provides a shielded power cable for use in mining or other related industries that is both robustly protected and is sufficiently flexible to withstand numerous cycles of coiling/uncoiling each day.

To this end the present arrangement is directed to an electric cable having two insulated power conductors, a pilot/ground wire assembly, a saddle positioned between the two insulated power conductors with the pilot ground assembly being contained within the saddle, the saddle being constructed from a semi-conductive polymer that is flexible.

An inner sheath surrounds the saddle and the two insulated power conductors, where the inner sheath is constructed from a semi-conductive polymer and where the inner sheath, saddle and two conductors form a flat cable. An outer sheath of high mechanical strength material is disposed around the outside of the inner sheath.

BRIEF DESCRIPTION OF THE DRAWINGS

The present invention can be best understood through the following description and accompanying drawing, wherein.

DETAILED DESCRIPTION

Figure 1:
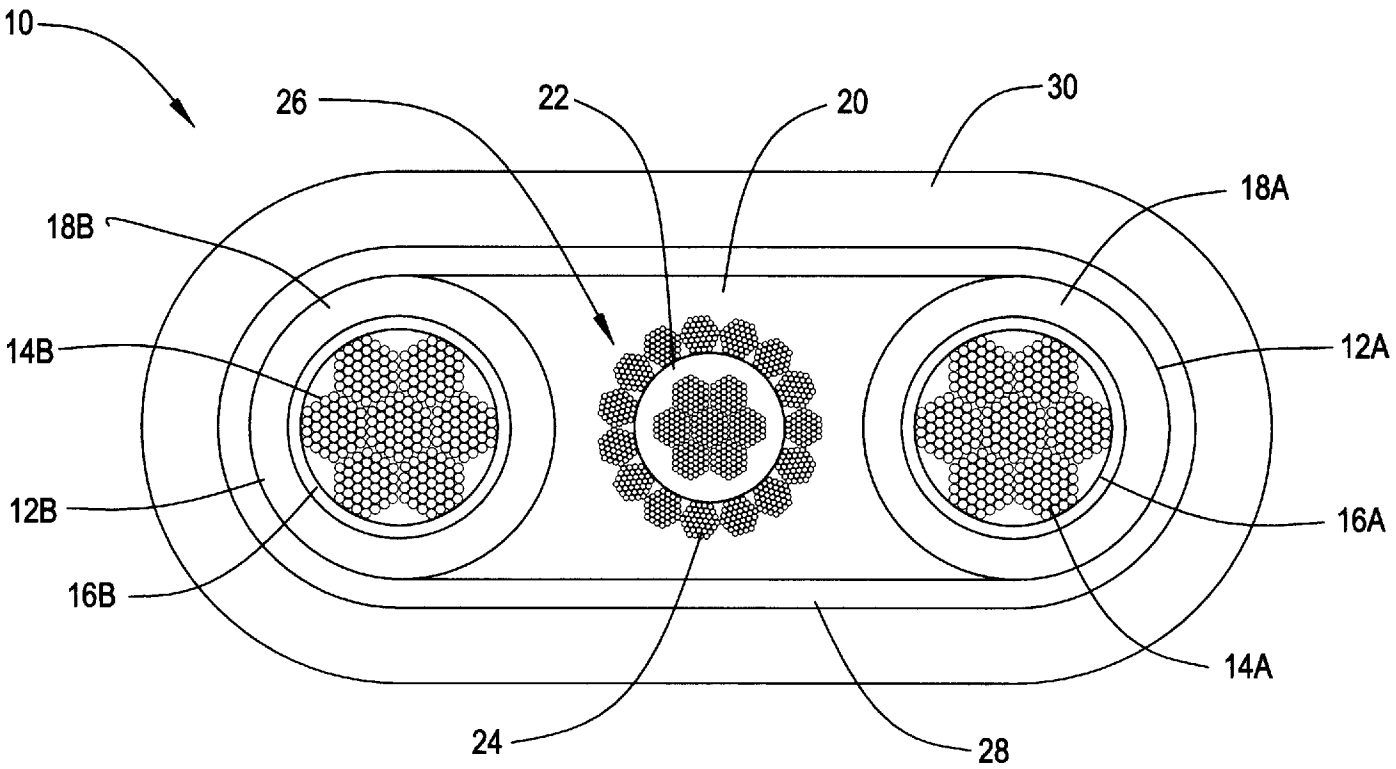
FIG. 1 illustrates one example of a power cable in accordance with one embodiment.

In one embodiment of the present invention as shown in FIG. 1, a power cable 10 is provided for mining cars and the like. In this arrangement, cable 10 has two power conductors 12A and 12B each made of a plurality of stranded and bundled metal wires 14A/14B, surrounded respectively by conductor screens 16A/16B and insulation 18A/18B.

In one arrangement wires 14A/14B of conductors 12A/12B are constructed as seven (7) bundles of stranded tinned copper wires, each bundle having thirty seven (37) wires with a cross sectional area of about 35 $mm^2$. However, additional constructions are possible such as 7 bundles with 19 wires each or 7 bundles with 47 wires each. Conductor screens 16A/16B are preferably constructed from an extruded semi-conductive cross-linked polyethylene (XLPE) of about 0.51 mm thickness. However other materials and thicknesses could be used such as a semi-conductive polymer tape screen, used in lieu of an extruded semi-conductive screen or in addition thereto. In one embodiment conductor insulators 18A and 18B are made from 1.52 mm thick ethylene propylene rubber (EPR) with coloring or ink printed (colored) as needed.

As shown in FIG. 1, between conductors 12A and 12B, a saddle 26 and pilot/ground wire 20/24 assembly is provided for grounding and supporting conductors 12A and 12B during repetitive coiling. Such an arrangement additionally has a pilot wire 20, surrounded by an insulation 22 which in turn is surrounded by a series of grounding wires 24 within saddle 26.

In one arrangement, pilot wire 20 is made from a braided tinned copper wire with an exemplary cross-section of about 8 $mm^2$. However a larger wire could be used in conjunction with larger conductors 12A/12B. Insulation 22 surrounding pilot wire 20 is preferably constructed from polypropylene, but other possibilities are available such as EPR, or a thermoplastic elastomer (TPE). The surrounding ground wires 24 are preferably constructed as 17 stranded 1.3 $mm^2$ copper wires (each of which are made from seven (7) bundled wires totaling 1.3 $mm^2$ in cross section). In certain instances if pilot wire 20 is increased in size, e.g. owing to larger power conductors 12A/12B, this may necessitate more strands of ground wires 24 to fully cover pilot insulation 22. For example a 70 $mm^2$ in cross-section power conductor 12A/12B might have a 16 $mm^2$ cross-section pilot 20 and require twenty (20) or more stranded 1.3 $mm^2$ copper bundles for ground wire 24.

It is noted that the above arrangement of pilot wire 20 and ground wires 24 are typically required in some instances for safety standards. Ground wires 24 may be attached at one end to a mining shuttle car frame and at the other end to the coupler at the remotely located power supply. This grounding circuit travels in turn through stationary cables all the way back to a grounding bed located outside of the mine. This bed is to assure that all equipment in the mine is securely grounded in case a power conductor, such as conductors 12A/12B contacts any machine frame. Pilot wire 20 simply monitors ground wire 24 for continuity.

As shown in FIG. 1, between conductors 12A/12B and surrounding pilot/ground wire assembly 20/22/24, a saddle 26 is formed of an extruded semi-conductive polymer to seat the two conductors 12A and 12B. In one arrangement saddle 26 is made using a die-shaped extrusion and is constructed from black semi-conductive chloroprene rubber (CR—generically called Neoprene™) which includes carbon black additive to make the polymer semi-conductive. Other polymers for saddle 26 may include chloro-sulfonated polyethylene (CSPE) which likewise has incorporated carbon black.

As shown in FIG. 1, the shape and material selection for saddle 26, used to encase ground assembly 24 and pilot wire 20, provide a distinct advantage over prior art shuttle car cables. For example, the cradle shape of saddle 26 and intimate contact with the centrally located grounding conductor 24 is useful in holding all of the elements of cable 10 in place during the lifetime of coiling the cable, which as noted above could be hundreds of times per day or more. The selection of semi-conductive CR or CSPE provide saddle 26 with flexibility that can also be easily "loaded" with high levels of carbon black, whereas other polymers cannot readily incorporate enough carbon black into the rubber to reach desired conductivity set by some exemplary grounding/safety standards which is 200 Ω·m at 23° C. maximum.

As shown in FIG. 1, surrounding conductors 12A and 12B and the entire saddle 26, ground assembly 24 and pilot wire 20, is a semi conductive inner sheath 28. In a preferred embodiment, inner sheath 28 is constructed from the same material as saddle 26 namely semi-conductive chloroprene rubber (CR or Neoprene™) or semi-conductive chloro-sulfonated polyethylene (CSPE) either one of which would include sufficient carbon black to reach the desired conductivity of the rubber which is 200 Ω·m at 23° C. maximum.

As a result of this construction, both conductors 12A and 12B are completely surrounded by a semi conductive polymer sheathing on the inside between conductors via saddle 26 and on the outside of conductors 12A and 12B by inner sheath 28.

The combination of semi-conductive rubber inner sheath 28 and saddle 26 completely surrounds and protects power conductors 12A and 12B from a user who may come into contact with an energized conductor as can happen on a non-shielded shuttle car cable. Additionally, semi-conductive inner sheath 28 is lighter in weight, but has a significant advantage in durability as prior art copper braid shields fatigue rapidly on flat cables since there is no helix that is absorbing and becoming damaged by the mechanical forces as is the case with a round braid shield cable as discussed above in the prior art.

As shown in FIG. 1 the exterior of cable 10 is coated finally with an outer isolative sheath 30. In a preferred embodiment, sheath 30 is constructed of about 3.18 mm thick black chlorinated polyethylene (CPE) or black chloroprene rubber (CR—Neoprene™).

Cable 10 and the accompanying description of components is intended to be exemplary. Certain additional features may be added to the cable such as colorants, binders or other cable accessories without deviating from the salient features of the invention. Moreover, the above design is for a DC cable with two conductors 12A and 12B. However, inventive features of the present application may likewise be applicable to an AC cable design having three conductors.

Figure 2:
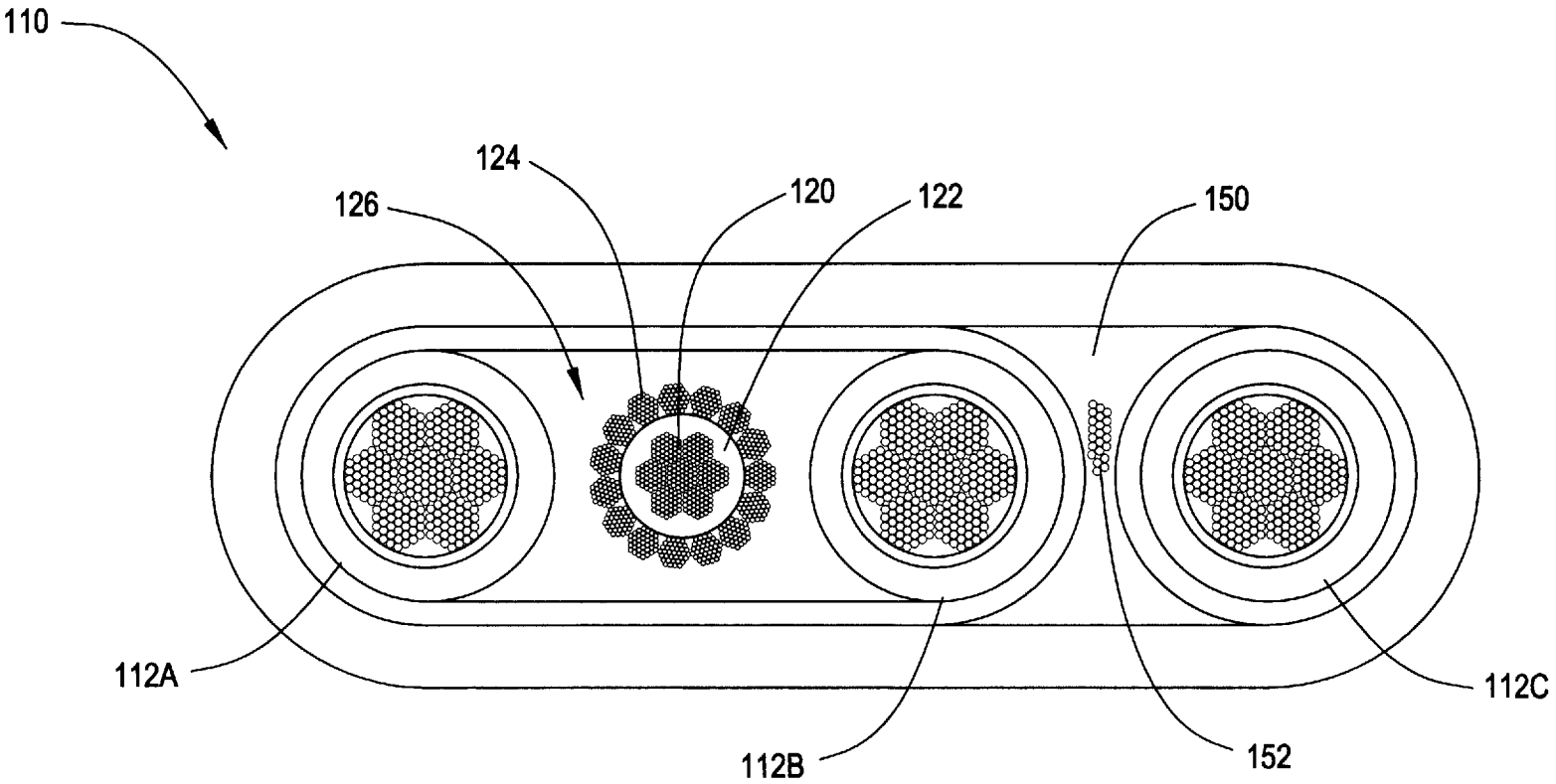
FIG. 2 illustrates another example of a power cable in accordance with one embodiment.

For example, FIG. 2 shows an AC cable 110 that has three conductors 112A, 112B and 112C, each having a similar construction to conductors 12A and 12B. Here cable 110 has the same pilot wire 120 and ground wire 124 as well as saddle 126, again of similar qualities as those described above. In FIG. 2, owing to the third conductor 112C, an additional saddle 150 is placed between conductor 112B and 112C and may also include some additional grounding cables 152, such as 4 $mm^2$ flexible stranded tinned copper grounding wires, within saddle 150 as required.

Applicants note that the above described cable 10 and the appurtenant features are exemplary and are not intended to limit the scope of the invention. For example other cables that are similarly constructed with possibly four or more conductors, or with one conductor, but otherwise substantially similarly constructed are intended to be within the purview of this invention.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. An electric cable, said cable comprising:

a plurality of insulated power conductors;

a pilot and ground wire assembly;

a saddle positioned between said plurality of insulated power conductors with said pilot and ground assembly being positioned within said saddle, said saddle constructed from a semi-conductive polymer;

an inner sheath surrounding said saddle and said plurality of insulated power conductors, wherein said inner sheath is constructed from a semi-conductive polymer and wherein said inner sheath, saddle and said plurality of conductors form a flat cable; and an outer insulating sheath disposed around the outside of said inner sheath, wherein each of said plurality of insulated conductors is completely surrounded by semi-conductive polymer from the combination of said inner sheath and said saddle.

2. The cable as claimed in claim 1, wherein said plurality of conductors are two insulated conductors that are constructed as a series of stranded tinned copper wires, surrounded by a semi-conductive polymer, which in turn is surrounded by an insulator polymer.

3. The cable as claimed in claim 1, wherein said saddle is extruded semi-conductive polymer.

4. The cable as claimed in claim 3, wherein said semi-conductive polymer forming said saddle is selected from the group consisting of black semi-conductive chloroprene rubber (CR) or semi-conductive chloro-sulfonated polyethylene (CSPE).

5. The cable as claimed in claim 4, wherein said saddle includes carbon black to make said saddle semi-conductive.

6. The cable as claimed in claim 4 wherein said semi-conductive polymer forming said inner sheath surrounding said saddle is selected from the group consisting of black semi-conductive chloroprene rubber (CR) or semi-conductive chloro-sulfonated polyethylene (CSPE).

7. An electric cable, said cable comprising:

first, second and third insulated power conductors;

a pilot and ground wire assembly;

a first saddle positioned between said first and second insulated power conductors with said pilot and ground assembly being contained with said first saddle, said first saddle constructed from a semi-conductive polymer;

a second saddle positioned between said second and third insulated power conductors with additional ground wires contained therein, said second saddle constructed from a semi-conductive polymer;

an inner sheath surrounding said saddles and said insulated power conductors, wherein said inner sheath is constructed from a semi-conductive polymer and wherein said inner sheath, saddles and conductors form a flat cable; and an outer insulating sheath disposed around the outside of said inner sheath, wherein each of said plurality of insulated conductors is completely surrounded by semi-conductive polymer from the combination of said inner sheath and said saddles.

8. The cable as claimed in claim 1, constructed as a central conductor composed of bundled tinned copper wires, surrounded by an insulation layer, in turn surrounded by a plurality of grounding wire stranded around said insulation layer.

* * * * *